United States Patent [19]

Walsh et al.

[11] Patent Number: 4,723,927

[45] Date of Patent: Feb. 9, 1988

[54] MARINE DRIVE OUTBOARD ENGINE COWL

[75] Inventors: James R. Walsh; Robert H. Boede, both of Oshkosh, Wis.

[73] Assignee: Brunswick Corporation, Skokie, Ill.

[21] Appl. No.: 898,342

[22] Filed: Aug. 20, 1986

[51] Int. Cl.[4] ..... B63B 17/00; F02M 35/00

[52] U.S. Cl. ..... 440/77; 440/88; 440/900; 181/229

[58] Field of Search ..... 440/76, 77, 88, 900; 123/195 C, 195 P, 198 E; 180/69.2, 69.22, 69.25, 68.3; 181/204, 229, 264, 267; 55/276

[56] References Cited

U.S. PATENT DOCUMENTS

| | | | |
|---|---|---|---|
| 2,815,742 | 12/1957 | Kiekhaefer | 123/195 C |
| 3,195,530 | 7/1965 | Heidner | 440/77 |
| 3,557,902 | 1/1971 | Brown | 181/229 |
| 3,610,198 | 10/1971 | Alexandrowicz | 440/77 |
| 4,379,702 | 4/1983 | Takada et al. | 440/77 |
| 4,403,971 | 9/1983 | Kobayashi et al. | 440/88 |
| 4,509,926 | 4/1985 | Jacobson | 440/77 |
| 4,620,607 | 11/1986 | Breckenfeld | 181/229 |

*Primary Examiner*—Joseph F. Peters, Jr.
*Assistant Examiner*—Edwin L. Swinehart
*Attorney, Agent, or Firm*—Andrus, Sceales, Starke & Sawall

[57] ABSTRACT

A cowl (2) is provided for a marine drive outboard engine (4). A front shield (26) covers a front throat (24) of the cowl for receiving combustion air and defines an input air path flowing rearwardly (28), then forwardly (30), then rearwardly (32) into the throat. Side scoops (52, 54, 60, 62) receive air flowing rearwardly and direct same interiorly of the cowl. Separators (68, 72) on the inner surfaces of the left and right sides (20, 22) of the cowl separate water from the incoming fresh air, and have upper vent openings (70, 74) allowing separated air to escape into the interior of the cowl. Upper vent openings (76, 78) in the top (16) of the cowl communicate with the upper vent openings (70, 74) in the separators (68, 72) to allow hot air to escape. The rear (18) of the cowl includes one or more discharge openings (80, 82) communicating with the bottom of the separators (68, 72) to allow water to escape.

9 Claims, 2 Drawing Figures

MARINE DRIVE OUTBOARD ENGINE COWL

BACKGROUND AND SUMMARY

The invention provides a cowl for a marine drive outboard engine, and particularly addresses problems of how to supply a large volume of fresh air to the engine, remove hot air, separate water from the fresh air, and seal the cowl from water pressure from the bottom of the boat.

Air is supplied through scoops on the sides of the cowl and through an intake throat behind a front shield. Water is separated from the air by water separators on the inner sides of the cowl, with water being discharged rearwardly. The separators have upper vent openings which communicate with upper vent openings in the cowl to allow escape of hot air. A lower tray and joint seals the cowl from water pressure from the bottom of the boat.

DETAILED DESCRIPTION

Figure 1:
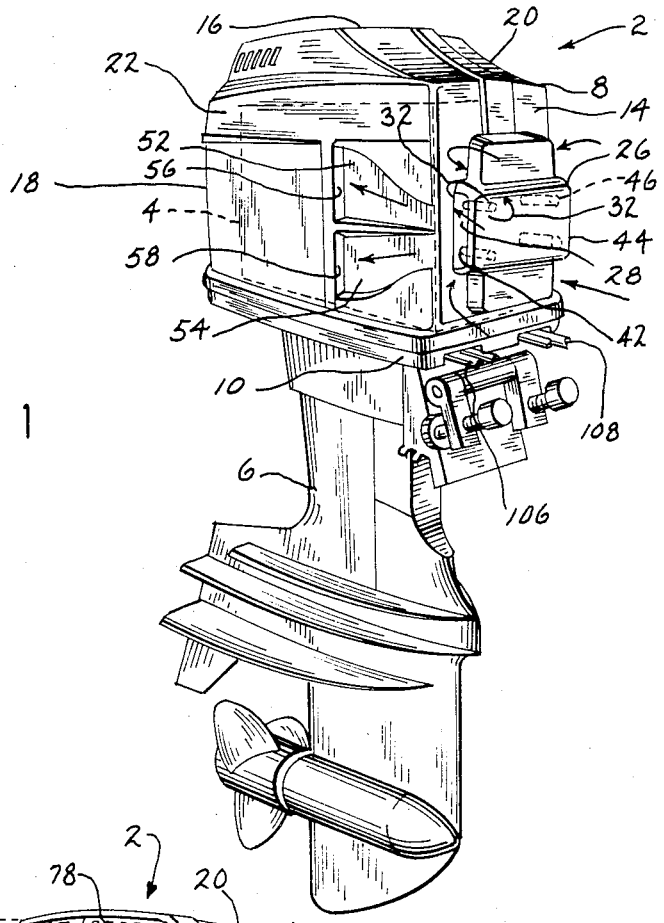
FIG. 1 is a perspective assembled view of a cowl constructed in accordance with the invention.
Figure 2:
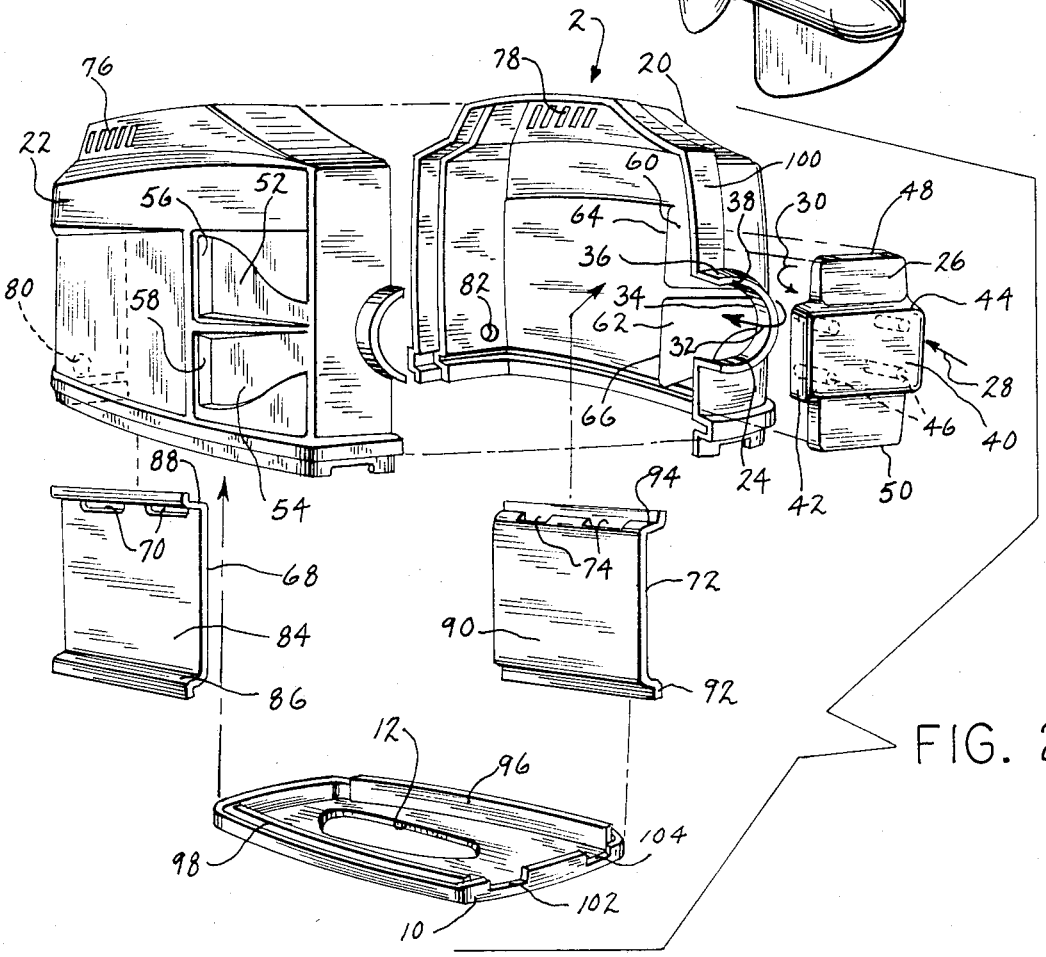
FIG. 2 is an exploded perspective view of the cowl of FIG. 1.

FIG. 1 shows a cowl 2 for a marine drive outboard engine 4 and depending propeller driveshaft casing 6. The cowl is provided by a main body 8 around the engine and having a bottom 10, as shown in FIG. 2, with an aperture 12 through which propeller driveshaft casing 6 extends. Main body 8 has a front 14 which faces in the direction of movement of the drive, and has a top 16, rear 18, and left and right sides 20 and 22.

Main body 8 has a front throat 24 for receiving combustion air for the engine. A front shield 26 covers front throat 24 and has portions spaced therefrom and defining an input air path flowing in a first rearward path 28 and then flowing in a forward path 30 adjacent throat 24 and then flowing in a second rearward path 32 into the throat and into the interior of the cowl for supplying combustion air. Throat 24 is defined by an opening 34 in the front of main body 8 and a closed-loop wall 36 around the opening and extending forwardly therefrom to a forward edge 38. Front shield 26 has a central portion 40 spanning opening 34 and spaced forwardly of forward edge 38 of throat wall 36. Front shield 26 has side flange portions 42, 44 external to throat 24 and adjacent throat wall 36 and extending rearwardly beyond forward edge 38 of throat wall 36, such that the first rearward flow path 28 is along the exterior of side flange portions 42, 44, and the forward flow path 30 is between side flange portions 42, 44 and throat wall 36, and the second rearward flow path 32 is into throat 24. The front shield is mounted to the front of main body 8 by stand-off bosses such as 46 therebetween, or by extended upper and lower flanges 48, 50, or by any other mounting arrangement for spacing the front shield from the throat.

A pair of scoops 52, 54 are on the right side 22 of the main body of the cowl and have respective forwardly facing openings 56, 58 for receiving air flowing rearwardly and directing such air interiorly of the cowl. Left side 20 likewise has a pair of scoops 60, 62 with respective forwardly facing openings 64, 66. A separator 68 is on the inner surface of right side 22 of the cowl body adjacent and rearward of scoop openings 56, 58 for trapping water and preventing water flow further laterally inwardly into the cowl main body. Separator 68 has upper vent openings 70 allowing air to escape into the interior of the cowl main body. Water is collected at the bottom of the separator. Left separator 72 is on the inner surface of left side 20 of the cowl body adjacent and rearward of left scoop openings 64, 66 for trapping water and preventing water flow further laterally inwardly into the cowl main body. Left separator 72 has upper vent openings 74 allowing air to escape into the interior of the cowl main body. Water is collected at the bottom of left separator 72. Upper vent openings 76, 78 are provided in the top 16 of the cowl and communicate with upper vent openings 70, 74 in the right and left separators to allow air to escape. One or more discharge openings 80, 82 are provided at the rear 18 of the cowl and communicate with the bottom of separators 68, 72 to allow water to escape.

Separator 68 has a central sheet-like wall 84 extending from scoops 52, 54 rearwardly to the rear 18 of the cowl body. Sheet-like wall 84 is spaced from and mounted to the inner side of the cowl body by a lower channel leg 86 proximate the bottom of the cowl main body and an upper channel leg 88 proximate the top of the cowl main body. Lower channel leg 86 extends from the scoops 52, 54 rearwardly to the rear of the cowl main body and collects water. Upper channel leg 88 has the noted upper vent openings 70 formed therein. Separator 68 is open at the front and rear, and is sealed along its bottom to the inner side of the main cowl body by lower channel leg 86. Lower and upper channel legs 86 and 88 are bonded by epoxy to the inner surface of right side 22 of the cowl body. Left separator 72 likewise includes a central sheet-like wall 90 extending from scoops 60, 62 rearwardly to the rear 18 of the cowl main body. Sheet-like wall 90 is spaced from and mounted to the inner left side of the cowl main body by a lower channel leg 92 proximate the bottom of the cowl main body, and by an upper channel leg 94 proximate the top of the cowl main body. Lower channel leg 92 extends from left scoops 60, 62 rearwardly to the rear of the cowl main body and collects water. Upper channel leg 94 has the noted upper vent opening 74 formed therein. Left separator 72 is open at the front and rear and is sealed along its bottom to the inner left side of the cowl main body by lower channel leg 92. Lower and upper channel legs 92 and 94 are bonded by epoxy to the inner surface of left side 20 of the cowl main body.

Cowl main body 8 is a three piece assembly having bottom tray 10 with aperture 12 therethrough, and a split housing having left and right halves 20 and 22 mounted on bottom tray 10 in respective guide rails 96, 98. Bottom tray 10 seals the cowl from water pressure from below. The upper housing is split along a longitudinal line extending forwardly-rearwardly. Left housing half 20 includes an overlap flange 100 extending along the noted longitudinal line for overlapping and sealingly mounting right housing half 22 thereto. One or more openings 102, 104 are provided at the joint of the front of bottom tray 10 and left and right housing halves 20 and 22 for receiving engine cable connections 106, 108 therethrough, which openings are sealed around the cables by foam rubber or other gasket material.

It is recognized that various alternatives and modifications are possible within the scope of the appended claims.

We claim:

1. A cowl for a marine drive outboard engine comprising:

a main body around the engine and having a front surface facing in the direction of travel of said marine drive and having a front throat through said front surface for receiving combustion air;

a front shield covering said front throat and having portions spaced from said front surface and from said front throat and defining an input air path flowing in a first rearward path to said front surface of said main body and then flowing in a forward path exterior of said main body from said front surface of said main body to said shield and adjacent said throat and then flowing in a second rearward path from said shield into said throat and into the interior of the cowl for supplying combustion air.

2. The invention according to claim 1 wherein:

said throat is defined by an opening in the front of said main body and a throat wall around said opening and extending forwardly therefrom to a forward edge;

said front shield has a central portion spanning said opening and spaced forwardly of said forward edge of said throat wall, and has side flange portions external to said throat and adjacent said throat wall and extending rearwardly beyond said forward edge of said throat wall such that said first rearward flow path is along the exterior of said side flange portions, said forward flow path is between said side flange portions and said throat wall, and said second rearward flow path is into said throat.

3. A cowl for a marine drive outboard engine comprising:

a main body around the engine and having a front which faces in the direction of movement of said drive, and having a top, rear and sides;

a scoop on the side of said main body and having a forwardly facing opening for receiving air flowing rearwardly and directing said air interiorly of the cowl;

a separator on the inner side of said main body adjacent and rearward of said scoop opening for trapping water and preventing water flow further laterally inwardly into said main body, said separator having one or more upper vent openings allowing air to escape into the interior of said main body, and wherein water is collected at the bottom of said separator;

one or more upper vent openings in the top of said main body communicating with said one or more upper vent openings in said separator to allow air to escape;

discharge means at the rear of said main body communicating with the bottom of said separator to allow water to escape.

4. The invention according to claim 3 wherein said separator comprises a central sheet-like wall extending from said scoop rearwardly to the rear of said main body and spaced from and mounted to the inner side of said main body by a lower channel leg proximate the bottom of said main body and an upper channel leg proximate the top of said main body, said lower channel leg extending from said scoop rearwardly to the rear of said main body and collecting water, said upper channel leg having said first mentioned one or more upper vent openings formed therein.

5. The invention according to claim 4 wherein said separator is open at the front and rear, and is sealed and bonded along its bottom to the inner side of said main body by said lower channel leg.

6. A cowl for a marine drive outboard engine and depending propeller driveshaft casing, comprising:

a main body around the engine and having a bottom with an aperture through which said propeller driveshaft casing extends, which bottom seals the cowl from water pressure from below, said main body having a front which faces in the direction of movement of the marine drive, and having a top, rear, and left and right sides, said front having a front throat for receiving combustion air;

a front shield covering said front throat and having portions spaced therefrom and defining an input air path flowing in a first rearward path and then flowing in a forward path adjacent said throat and then flowing in a second rearward path into said throat and into the interior of the cowl for supplying combustion air;

a left scoop on the left side of said main body and having a forwardly facing opening for receiving air flowing rearwardly and directing such air interiorly of the cowl;

a right scoop on the right side of said main body and having a forwardly facing opening for receiving air flowing rearwardly and directing such air interiorly of the cowl;

a left separator on the left inner side of said main body adjacent and rearward of said left scoop opening for trapping water and preventing water flow further laterally inwardly into said main body, said left separator having one or more upper vent openings allowing air to escape into the interior of said main body, and wherein water is collected at the bottom of said left separator;

a right separator on the right inner side of said main body adjacent and rearward of said right scoop opening for trapping water and preventing water flow further laterally inwardly into said main body, said right separator having upper vent openings allowing air to escape into the interior of said main body, and wherein water is collected at the bottom of said right separator;

one or more upper vent openings in the top of said main body communicating with said one or more upper vent openings in said left separator and communicating with said one or more upper vent openings in said right separator to allow air to escape;

discharge means at the rear of said main body communicating with the bottom of said left separator and communicating with the bottom of said right separator to allow water to escape.

7. The invention according to claim 6 wherein said main body is a three piece assembly with a bottom tray member with said aperture therethrough for said propeller driveshaft casing and a split housing with right and left halves secured together along a longitudinal forward-rearward line and open at the bottom and secured to said bottom tray to close the interior of the cowl, said left half providing said left side and half of said front, top and rear of said main body, said right half providing said right side and half of said front, top and rear of said main body.

8. The invention according to claim 7 wherein the front of said bottom tray and the front of said right and left halves meet at an interface, and comprising one or more openings at said interface for receiving engine connection cables therethrough.

9. The invention according to claim 6 wherein:

said throat is defined by an opening in the front of said main body and a throat wall around said opening and extending forwardly therefrom to a forward edge;

said front shield has a central portion spanning said opening and spaced forwardly of said forward edge of said throat wall, and has side flange portions external to said throat and adjacent said throat wall and extending rearwardly beyond said forward edge of said throat wall, such that said first rearward flow path is along the exterior of said side flange portions, said forward flow path is between said side flange portions and said throat wall, and said second rearward flow path is into said throat;

said left separator comprises a central sheet-like wall extending from said left scoop rearwardly to the rear of said main body and spaced from and mounted to the inner left side of said main body by a lower channel leg proximate the bottom of said main body and an upper channel leg proximate the top of said main body, said lower channel leg extending from said left scoop rearwardly to the rear of said main body and collecting water, said upper channel leg having said one or more vent openings of said left separator formed therein, said left separator being sealed and bonded along its bottom to the inner left side of said main body by said lower channel leg;

said right separator comprises a central sheet-like wall extending from said right scoop rearwardly to the rear of said main body and spaced from and mounted to the right inner side of said main body by a lower channel leg proximate the bottom of said main body and an upper channel leg proximate the top of said main body, said lower channel leg of said right separator extending from said right scoop rearwardly to the rear of said main body and collecting water, said upper channel leg of said right separator having said upper vent openings of said right separator formed therein, said right separator being sealed and bonded along its bottom to the right inner side of said main body by said last mentioned lower channel leg.

* * * * *